US005377432A

United States Patent [19]

Kishi

[11] Patent Number: 5,377,432

[45] Date of Patent: Jan. 3, 1995

[54] DEEP EXCAVATOR

[75] Inventor: Mitsuhiro Kishi, Ashikaga, Japan

[73] Assignee: Japanic Corporation, Ashikaga, Japan

[21] Appl. No.: 139,217

[22] Filed: Oct. 19, 1993

Related U.S. Application Data

[63] Continuation-in-part of Ser. No. 30,844, Mar. 12, 1993.

[30] Foreign Application Priority Data

Oct. 29, 1992 [JP] Japan ..... 4-313973

[51] Int. Cl.[6] ..... B66C 23/00

[52] U.S. Cl. ..... 37/186; 414/718; 414/912; 92/61

[58] Field of Search ..... 92/61; 91/167; 37/186, 37/187; 172/112, 114; 414/690, 718, 719, 722, 726, 727, 729, 912; 212/55, 266, 144

[56] References Cited

U.S. PATENT DOCUMENTS

| | | | |
|---|---|---|---|
| 2,828,038 | 3/1958 | Dorkins | 214/510 |
| 3,188,917 | 6/1965 | Quayle | 91/168 |
| 3,734,464 | 5/1973 | Bushnell, Jr. | 254/93 R |
| 3,754,666 | 8/1973 | Suverkrop | 212/59 R |
| 3,882,759 | 5/1975 | Formwalt et al. | 91/167 |
| 4,733,598 | 3/1988 | Innes et al. | 91/167 X |
| 4,854,810 | 8/1989 | Ramsey | 414/718 X |
| 5,092,733 | 3/1992 | Kishi | 414/718 |
| 5,267,824 | 12/1993 | Kishi | 414/718 |

*Primary Examiner*—Randolph A. Reese
*Assistant Examiner*—Robert E. Pezzuto
*Attorney, Agent, or Firm*—Flynn, Thiel, Boutell & Tanis

[57] ABSTRACT

A deep excavator comprising a stretchable arm arrangement having four telescopically assembled alms which are simultaneously extended and contracted for excavating earth or sand to form a deep hole. The stretchable arm arrangement houses therein a working unit comprising a pair of hydraulic cylinders which are arranged in parallel with each other while the cylinder rods thereof are disposed to operate in opposite directions and the hydraulic cylinder housings are assembled so as to relatively slide. The cylinder rods and the cylinder housings are individually coupled each to a respective arm whereby the arms are interlocked with the hydraulic cylinders so as to be extended simultaneously with the hydraulic cylinders when both of the hydraulic cylinders are extended.

9 Claims, 9 Drawing Sheets

16
6
11
9
10
8
4
5
13
14
3
2
1
B

DEEP EXCAVATOR

CROSS REFERENCE TO RELATED APPLICATION

This is a continuation-in-part of my copending application Ser. No. 08/030,844 filed Mar. 12, 1993.

FIELD OF THE INVENTION

The present invention relates to an excavator for deeply excavating the earth at a construction or building site, etc. to form a hole having a great depth, and particularly to an excavator having a stretchable boom which includes four telescopically assembled arms which can be simultaneously extended and contracted.

BACKGROUND OF THE INVENTION

There have been many cases at a construction or building site where the earth must be deeply excavated to form a hole having a depth which is too long relative to its diameter. For example, there have been cases for excavating the earth to form a hole in which an anchor supporting a steel tower is embedded, a hole in which a water purifier tank is embedded, a hole for ground making and a hole for well sinking. In such cases, the hole should generally have a depth which is too long, e.g. ranging from 15 m to 20 m, relative to its diameter, e.g. about 5 m.

In deep excavating work, there is conventionally employed a deep excavator having a telescopic mechanism comprising a stretchable arm arrangement fixed to a boom and wherein a clamshell bucket (hereinafter referred to as a bucket) is coupled to the tip end of a top arm of the stretchable arm arrangement. In the conventional deep excavator, the stretchable arm arrangement is typically fixed to the tip end of the boom and has at least two stages of arms in which the bucket suspended from the top arm is hung to reach the bottom of the hole.

In the conventional mechanism for extending and contracting each arm, a wire or chain is entrained around or extended between each arm whereby each arm is extended and contracted synchronously with one another by such wire or chain. In such a mechanism, it is possible to smoothly extend or contract each arm of the stretchable arm arrangement but the wire or chain must be entrained around or extended to each arm, which makes the arrangement of the wire or chain complex. Furthermore, since the wire or chain for contraction of each arm as well as extension of each arm must be entrained around or extend to each arm, at least two wires or chains are required for one arm, which leads to a complex arrangement of wires or chains. In such an arrangement, the wires or chains are liable to be exposed outside the stretchable arm which is not preferable in view of external appearance. There is also a likelihood that earth or sand becoming stuck to the wires or the chains, which causes abrasion or is troublesome to the mechanism.

Accordingly, there is proposed a mechanism for extending or contracting a stretchable boom using hydraulic power generated by a single hydraulic cylinder which is incorporated into the stretchable arm comprising a plurality of arms. However, in this mechanism the amount of extension of the stretchable boom is limited and the speed of extension is not increased. To solve these problems, there is further proposed a mechanism having two stretchable arms each having a hydraulic cylinder wherein the hydraulic cylinders are simultaneously operated to thereby extend and contract the entire stretchable arm assembly. However, if a plurality of hydraulic cylinders are accommodated in the stretchable arm, it is necessary to provide high pressure application hoses on each hydraulic cylinder coupled to each arm, which makes the mechanism complex.

To solve the problem, there has been proposed a mechanism, for example, as disclosed in my copending U.S. Ser. No. 08/030,844 for simultaneously operating three arms of a stretchable arm using a working unit comprising two hydraulic cylinder units which are assembled and arranged in parallel with each other and structured so that cylinder rods thereof are disposed to operate in opposite directions, wherein the hydraulic cylinder housings are fixed to a middle arm and each of the cylinder rods are coupled to one of the upper and lower arms. In this mechanism, since two hydraulic cylinder units can be operated, there are such advantages that an oil pressure hose is not necessary to be disposed complexly, and the extending and contracting speeds are increased. However, according to this mechanism, the telescopically assembled aim is limited to three arms which are operable simultaneously and cannot cope with more than three arms.

As mentioned above, according to the prior art deep excavator using the wire or chain, it takes substantial time for the bucket to reach the bottom of the hole, which obstructs the effective operation. In the new proposed arrangement using the working unit having two hydraulic cylinder units, since the two hydraulic cylinder units are fixed, there is a disadvantage in that only three arms can operate simultaneously. In this latter arrangement, there are advantages that the operating speed is increased and the trouble is decreased since the wire or chain is not used but there is a disadvantage that the depth of earth to be excavated from the ground is limited since the number of arms is limited to three. Under the circumstances, it is desired to realize an arrangement capable of operating fast, and capable of extending and contracting a stretchable arm arrangement having more than three arms.

SUMMARY OF THE INVENTION

In view of the drawbacks of prior art deep excavators, it is an object of the present invention to provide a deep excavator comprising a chassis, a turntable disposed on the chassis, a boom which is pivotally supported on the turntable and is vertically swingable, a stretchable arm which is stretchable in the longitudinal direction thereof and comprises four telescopically assembled outer, base, middle and top arms, a working unit accommodated in the stretchable boom for extending and contracting each arm, and a bucket which is attached to the top arm for excavating and holding earth or sand. The working unit comprises a pair of hydraulic cylinders which are arranged in parallel with each other so that cylinder rods thereof are disposed to operate in opposite directions, wherein the one hydraulic cylinder is coupled to the base arm while the cylinder rod thereof is coupled to the outer arm, and the other hydraulic cylinder is coupled to the middle arm while the cylinder rod thereof is coupled to the top arm. The deep excavator further comprises a synchronous means disposed between the base and middle arms for pulling out the top arm from the middle arm at the same time when the base arm is pulled out from the outer arm.

According to the present invention, the stretchable arm of the deep excavation comprises four telescopically assembled arms and a working unit comprising a pair of hydraulic cylinders disposed in the stretchable arm. In the working unit, two hydraulic cylinders are arranged in parallel with cylinder rods thereof disposed to operate in opposite directions. In this working unit, the cylinder rod of one hydraulic cylinder is connected to the outer arm and said one hydraulic cylinder is connected to the base arm, while the other hydraulic cylinder is connected to the middle arm and the cylinder rod thereof is connected to the top arm. Since the discharge chamber of one hydraulic cylinder communicates with the pressure chamber of the other hydraulic cylinder by way of a pressure hose, if oil under pressure is supplied to one hydraulic cylinder, the cylinder rod thereof is pulled out therefrom and at the same time the cylinder rod of the other hydraulic cylinder is pulled out therefrom. Accordingly, the base arm is pulled out from the outer arm while the top arm is pulled out from the middle arm. Furthermore, the outer and middle arms are connected to each other by a connecting belt wound around the middle arm so that the middle arm is pulled out from the base arm when the base arm is pulled out from the outer arm. In such a manner, the four arms of the stretchable boom are simultaneously extended so that the bucket can contact the bottom of a deep hole.

DETAILED DESCRIPTION

Figure 1:
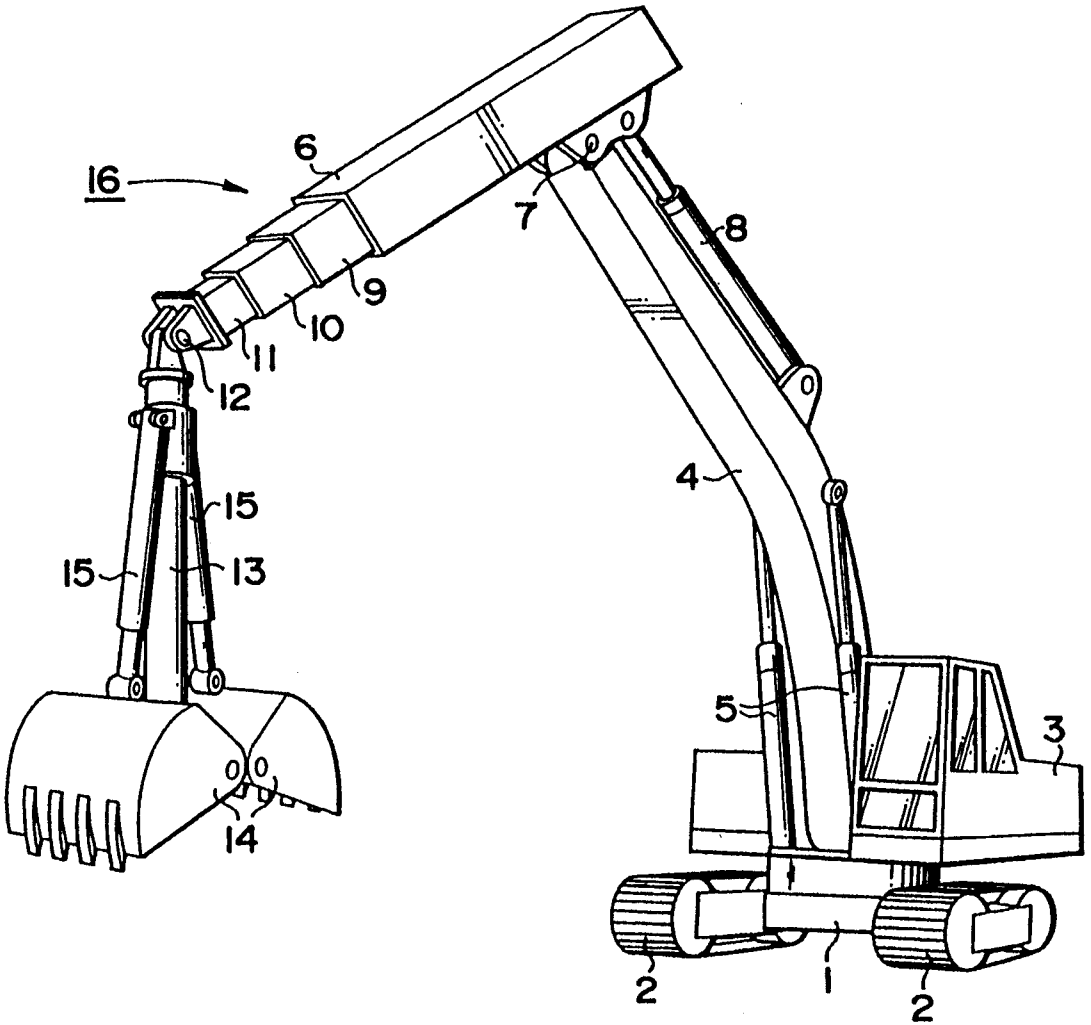
FIG. 1 is a perspective view of a deep excavator according to the present invention.
Figure 2:
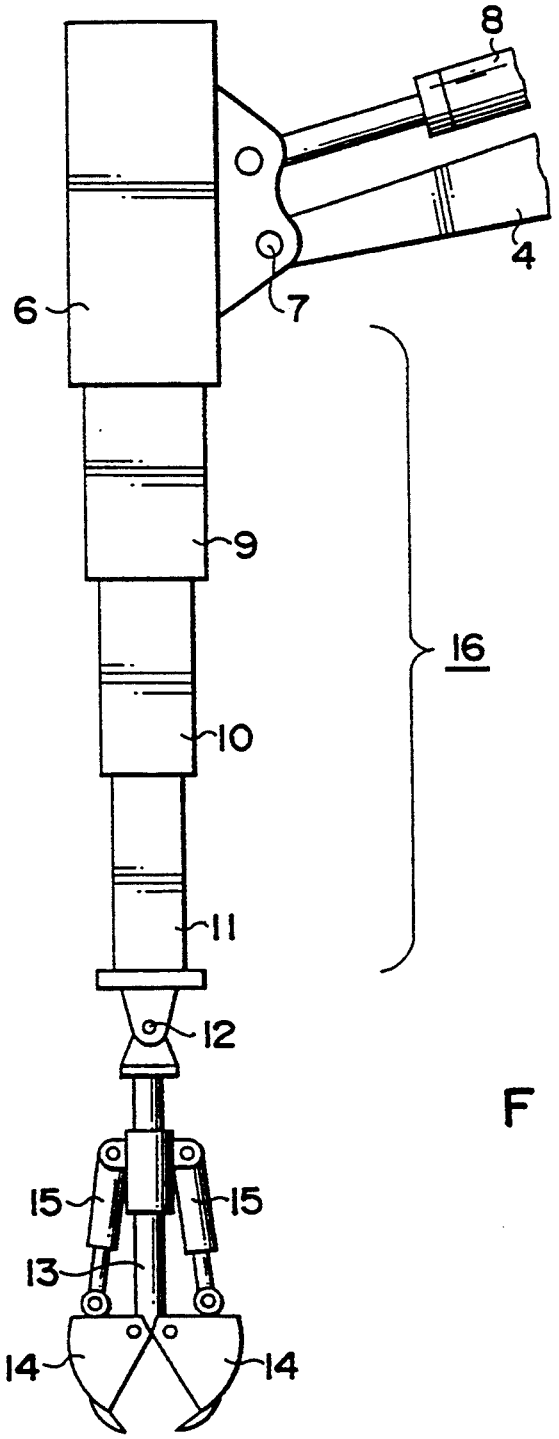
FIG. 2 is a side view of the entire external appearance of a stretchable arm according to the present invention.

An embodiment of a deep excavator according to the present invention will be described with reference to FIGS. 1 to 9.

Crawlers or tracks 2 are provided at both sides of a chassis 1 of a deep excavator which is freely movable, i.e. right and left, forward and rearward by these crawlers 2. A turntable 3 is disposed over the upper surface of the chassis 1 so as to be turned 360° horizontally. A substantially L-shaped boom 4 is pivotally mounted on an upper front surface of the turntable 3 so as to be swingable vertically. First hydraulic cylinder 5 is interposed between the center of the boom 4 and the front surface of the turntable 3 for vertically swinging the boom 4 relative to the turntable 3 at some angles. A long hollow outer arm 6 having a square shape in cross section is coupled to the tip end of the boom 4 by horizontal hinge pin 7 so as to be swingable vertically, and a second hydraulic cylinder 8 is interposed between the center of the rear surface of the boom 4 and the rear end of the outer arm 6 to control swinging of the outer arm 6. The outer arm 6 is formed by bending a thin steel plate and has a lower end opening through which a long hollow base arm 9, which is formed by bending a thin steel plate and has a square shape in cross section, is slidably inserted. The base arm 9 has a lower end opening through which a long hollow middle arm 10, which is formed by bending a thin steel plate and has a square shape in cross section, is slidably inserted. The middle arm 10 has a lower end opening through which a long hollow top arm 11, which is formed by bending a thin steel plate and has a square shape in cross section, is slidably inserted. These outer 6, base 9, middle 10 and top 11 arms constitute a telescopic stretchable arm arrangement 16. A cylindrical hanging shaft 13 is coupled to the tip end of the top arm 11 by a hinge pin 12 so as to be always directed downward by its own weight. A clamshell bucket 14, comprising a pair of bucket halves which are closable to excavate the earth or sand and hold the excavated earth or sand, is hingedly coupled to the lower end of the hanging shaft 13.

Third and fourth hydraulic cylinders 15 are interposed between the center of the hanging shaft 13 and rear surfaces of the bucket halves 14.

Figure 3:
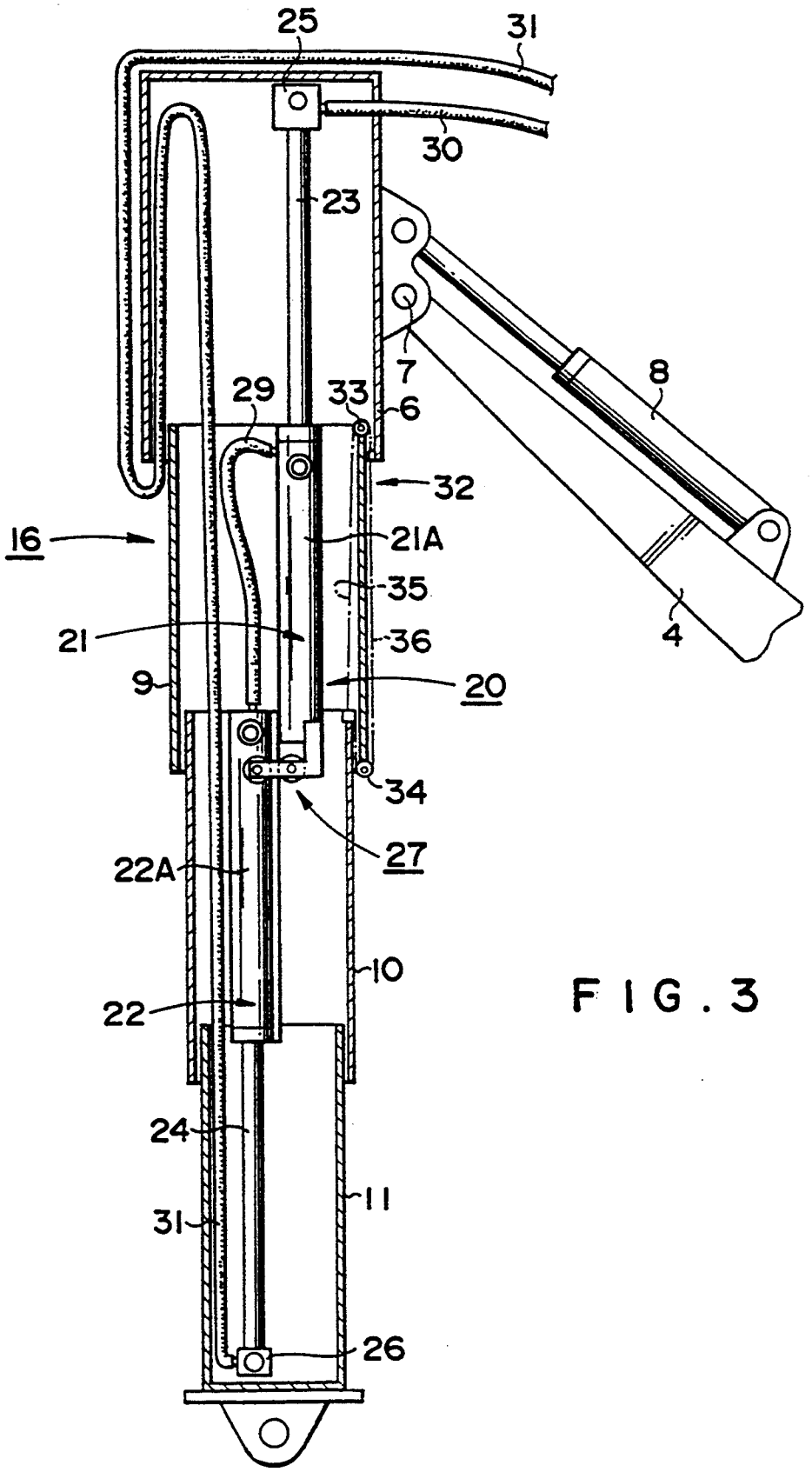
FIG. 3 is a side cross-sectional view of the internal arrangement of the stretchable arm according to the present invention.

As shown in FIG. 3, which is a cross-sectional view of the internal arrangement of the stretchable arm 16, the top arm 11 is slidably inserted into the middle arm 10, the middle arm 10 is slidably inserted into the base arm 9, and the base arm 9 is slidably inserted into the outer arm 6, whereby these arms respectively slide in the longitudinal directions thereof. A working or actuator unit 20 comprises a pair of hydraulic cylinder units 21 and 22 which have substantially the same shape and are arranged in parallel with each other in the axial directions thereof while working directions of the cylinder rods 23 and 24 thereof are opposite to each other. The hydraulic cylinder units 21 and 22 are slidable in the longitudinal directions relative to one another by a guide mechanism 27 and are assembled so that they do not move sidewardly.

The cylinder rod 23 of the hydraulic cylinder unit 21 is directed upward and the cylinder rod 24 of the hydraulic cylinder unit 22 is directed downward. A block shaped rod head 25 is fixed to the upper free end of the cylinder rod 23 and it is coupled to the outer arm 6 adjacent the upper end thereof, while the upper portion of the housing of hydraulic cylinder unit 21 is coupled to the base arm 9 adjacent the upper end thereof. A block shaped rod head 26 is fixed to the lower free end of the cylinder rod 24 of the hydraulic cylinder unit 22, and it is coupled to the top arm 11 adjacent the lower end thereof, while the upper end of the housing of hydraulic cylinder unit 22 is coupled to the middle boom 10 adjacent the upper end thereof. With such an arrangement, when the working unit 20 operates, the cylinder rod 23 is pushed out from the hydraulic cylinder unit 21 and the cylinder rod 24 is pushed out from the hydraulic cylinder unit 22 so as to extend the entire length thereof. Accordingly, the base arm 9 is pulled out from the outer arm 6 by the hydraulic cylinder unit 21 while the top arm 11 is pulled out from the middle arm 10 by the hydraulic cylinder unit 22. The upper pressure chamber of the hydraulic cylinder unit 21 is connected to the upper pressure chamber of the hydraulic cylinder unit 22 by a connecting hose 29 so that the oil under pressure flows therethrough. A pressure application hose 30 connected to a pressure source such as a pressure pump is connected to the rod head 25, and a pressure application hose 31 connected to a pressure source such as a pressure pump is connected to the rod head 26. The pressure application hose 31 is loosely disposed inside the stretchable boom 16 so as to not impede the operation thereof when the stretchable boom 16 is extended or contracted in the longitudinal direction thereof.

Pulleys 33 and 34 are respectively rotatably supported on the base arm 9 at the upper and lower ends thereof. An elongate chain 35 as a flexible connecting element is would around the pulley 33 and one end of the chain 35 is fixedly connected to the lower end of the outer arm 6 while the other end of the chain 35 is fixedly connected to the upper end of the middle boom 10. A second elongate chain 36 as a flexible connecting element is wound around the pulley 34 and one end of the chain 36 is connected to the lower end of the outer arm 6 while the other end of the chain 36 is connected to the upper end of the middle boom 10. The chains 35 and 36 thus effectively define an endless belt or chain which is wound endlessly around the inner and outer peripheries of the base arm 9. These pulleys 33–34 and elements 35–36 thus define a synchronous arrangement 32 for effective movement between arms 10 and 11.

Figure 4:
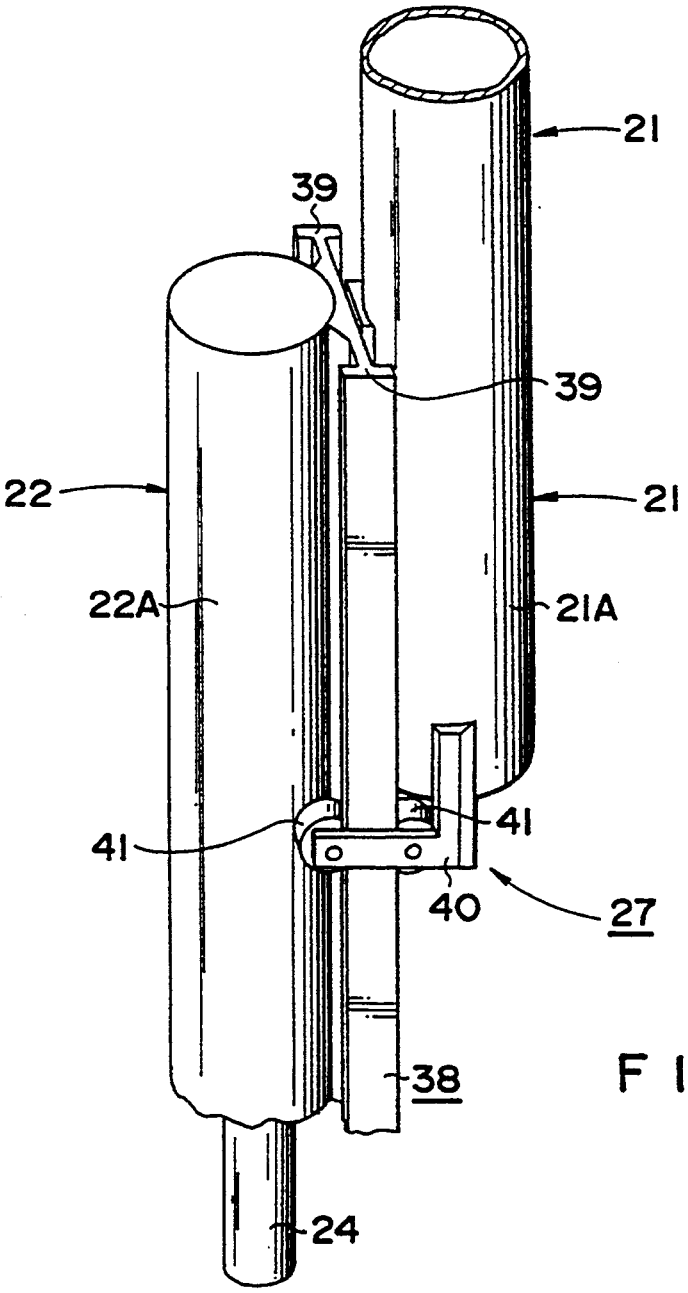
FIG. 4 is perspective view showing the combination of working units according to the present invention.
Figure 5:
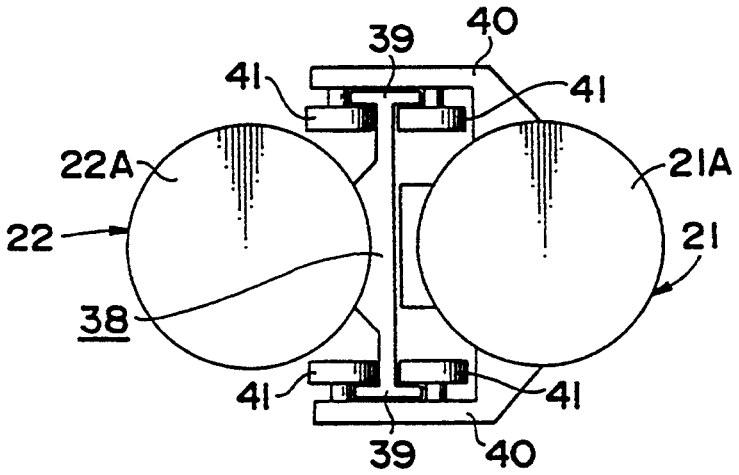
FIG. 5 is a plan view showing the combination of hydraulic cylinders constituting a working unit according to the present invention.

FIGS. 4 and 5 show the structure of the guide mechanism 27 for slidably holding the hydraulic cylinder units 21 and 22 in the longitudinal directions thereof. A guide rail 38 having the shape of a rail is fixed to the side surface of the housing 22A of hydraulic cylinder unit 22 in the longitudinal direction thereof and has guide protrusions 39 which protrude in T-shape at both sides thereof. The protrusions 39 extend in the longitudinal directions thereof with the same width. Shaft supporting bodies 40 which respectively have substantially L-shapes are fixed at both sides of the lower end of the housing 21A of hydraulic cylinder unit 21, and the interval or spacing between the supporting bodies 40 is slightly broader than the width of the guide rail 38. Two rollers 41 are supported by each of the supporting bodies 40 with an interval defined therebetween, and both side surfaces of the guide rail 38 are brought into contact with the shaft supporting bodies 40. The inner side surfaces of the guide protrusions 39 are brought into contact with the outer peripheries of the rollers 41. Since the rollers 41 are guided by the inner peripheral surfaces of the guide protrusions 39, the hydraulic cylinder units 21 and 22 can be freely relatively movable in the axial directions thereof by the guidance of the rollers 41, but are prevented from moving sidewardly.

Figure 6:
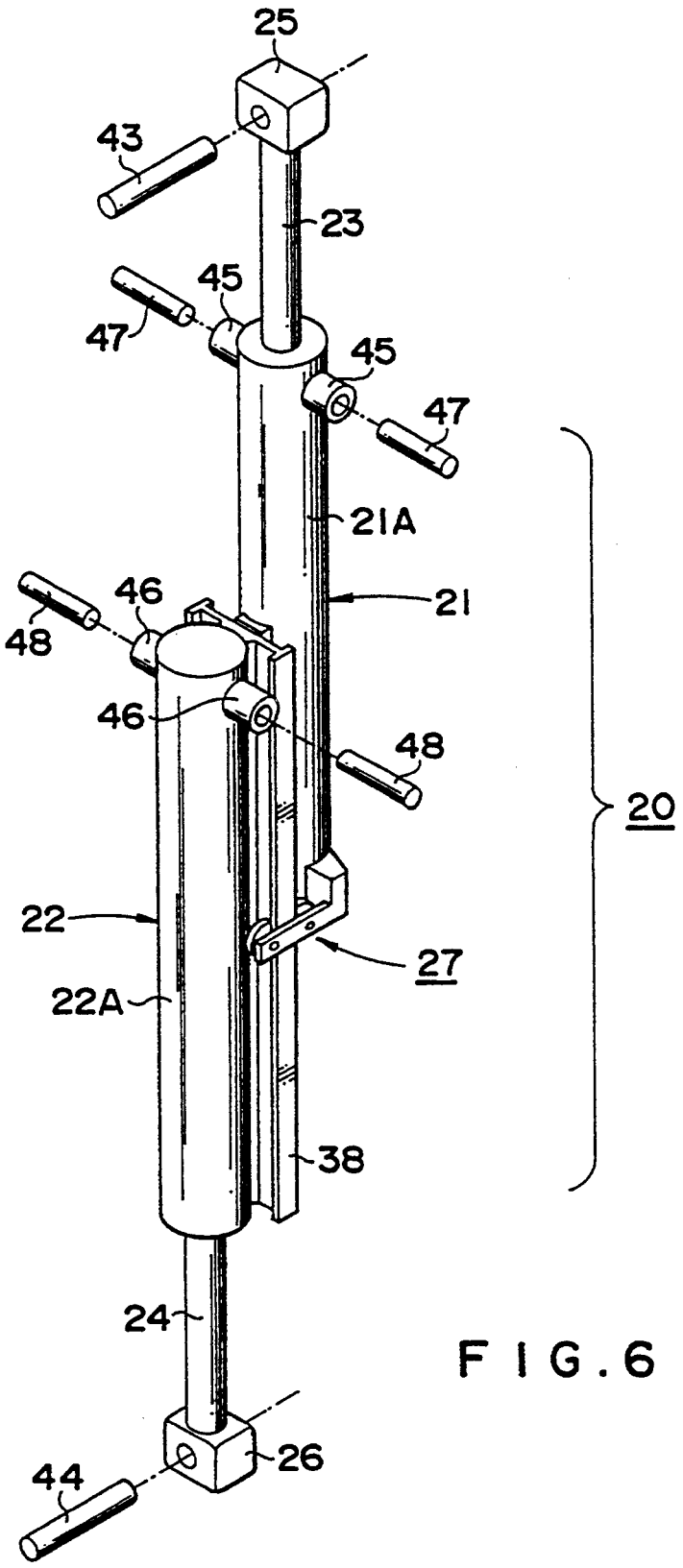
FIG. 6 is an exploded perspective view of the working unit according to the present invention.

FIG. 6 shows the connections between the working unit 20 and the stretchable arm 16. The rod head 25 is fixed to the upper end of the cylinder rod 23 and has an opening at the side surfaces thereof. A pin 43 which is to be fixed to the inner periphery of the outer arm 6 is inserted into the opening of the rod head 25. Cylindrical pin receivers 45 are fixed to right and left side surfaces of the upper end of the housing of hydraulic cylinder 21. Pins 47 to be connected to the inner side of the base arm 9 are inserted into the pin receivers 45. Cylindrical pin receivers 46 are fixed to right and left side surfaces of the upper end of the housing of hydraulic cylinder unit 22. Pins 48 to be connected to the inner side of the middle arm 10 are inserted into the pin receivers 46. An opening is formed at the side surfaces of the rod head 26 which is fixed to the lower end of the cylinder rod 24 and a pin 44 to be connected to the top arm 11 is inserted into this opening. In such a manner, the rod head 25 is coupled to the outer arm 6 and the hydraulic cylinder unit 21 is coupled to the base arm 9 while the hydraulic cylinder unit 22 is coupled to the middle arm 10 and the rod head 26 is coupled to the top arm 11. Members which respectively extended and contracted in the working unit 20 are thus integrally connected to the outer 6, base 9, middle 10 and top 11 arms of the telescopically assembled stretchable arm 16.

Figure 7:
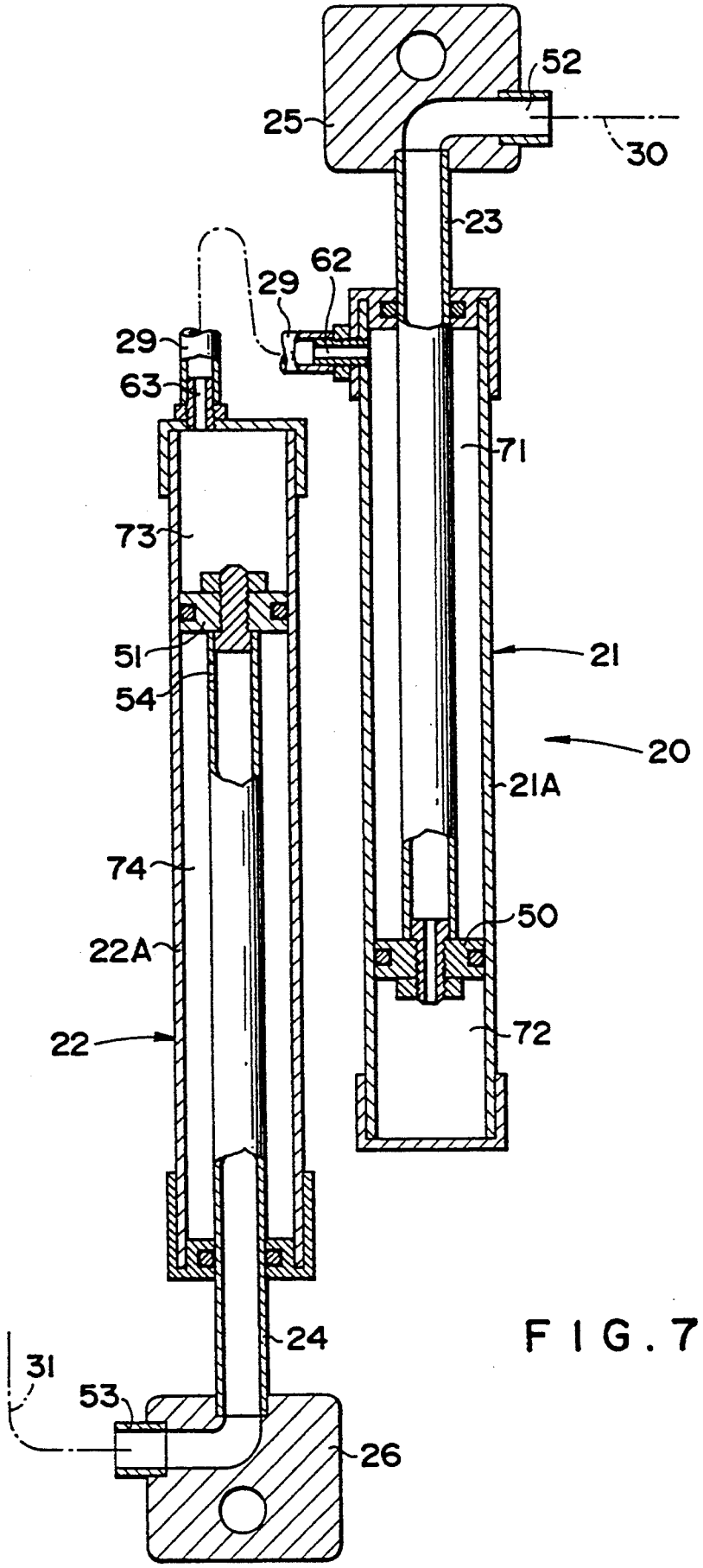
FIG. 7 is a cross-sectional view of the internal arrangement of the working unit according to the present invention.

FIG. 7 shows the internal arrangement of the hydraulic cylinder units 21 and 22. The hydraulic cylinder unit 21 has a piston 50 which is slidably and airtightly inserted thereinto for partitioning the inner space of the housing 21A in two pressure sections or chambers 71 and 72. The piston 50 is fixed to the lower end of the cylinder rod 23. The cylinder rod 23 is hollow and shaped as a round pipe. The cylinder rod 23 has an upper end which communicates with a port 52 provided at the side surface of the rod head 25 and a lower end which communicates with the lower pressure chamber 72 of the hydraulic cylinder 21 by way of the piston 50. The cylinder housing 21A has a port 62 provided at the side surface of the upper portion thereof which communicates with an upper pressure (i.e. discharge) chamber 71 thereof which in turn is connected to the connecting hose 29.

The housing 22A of hydraulic cylinder unit 22 has a port 63 which is provided at the upper portion thereof and communicates with the upper pressure chamber 73 thereof and is connected to the connecting hose 29. The chamber 71 of the cylinder unit 21 always communicates with the chamber 73 of the cylinder unit 22 by way of the connecting hose 29.

The hydraulic cylinder unit 22 has inside thereof a piston 51 which is slidably and airtightly inserted thereinto for partitioning the inner space of the housing 22A vertically into two pressure sections or chambers 73 and 74. The upper end of the cylinder rod 24 is connected to the piston 51. The cylinder rod 24 is hollow at the inside thereof and is shaped as a round pipe and has an introduction port 54 at the side surface of the upper end thereof for per,hitting the lower pressure (i.e. discharge) chamber 74 provided at the lower portion of the cylinder housing 22A to communicate with the interior of the cylinder rod 24. The rod head 26 is connected to the lower end of the cylinder rod 24 and has a port 53 at the side surface thereof which communicates with the inner space of the cylinder rod 24.

Figure 8:
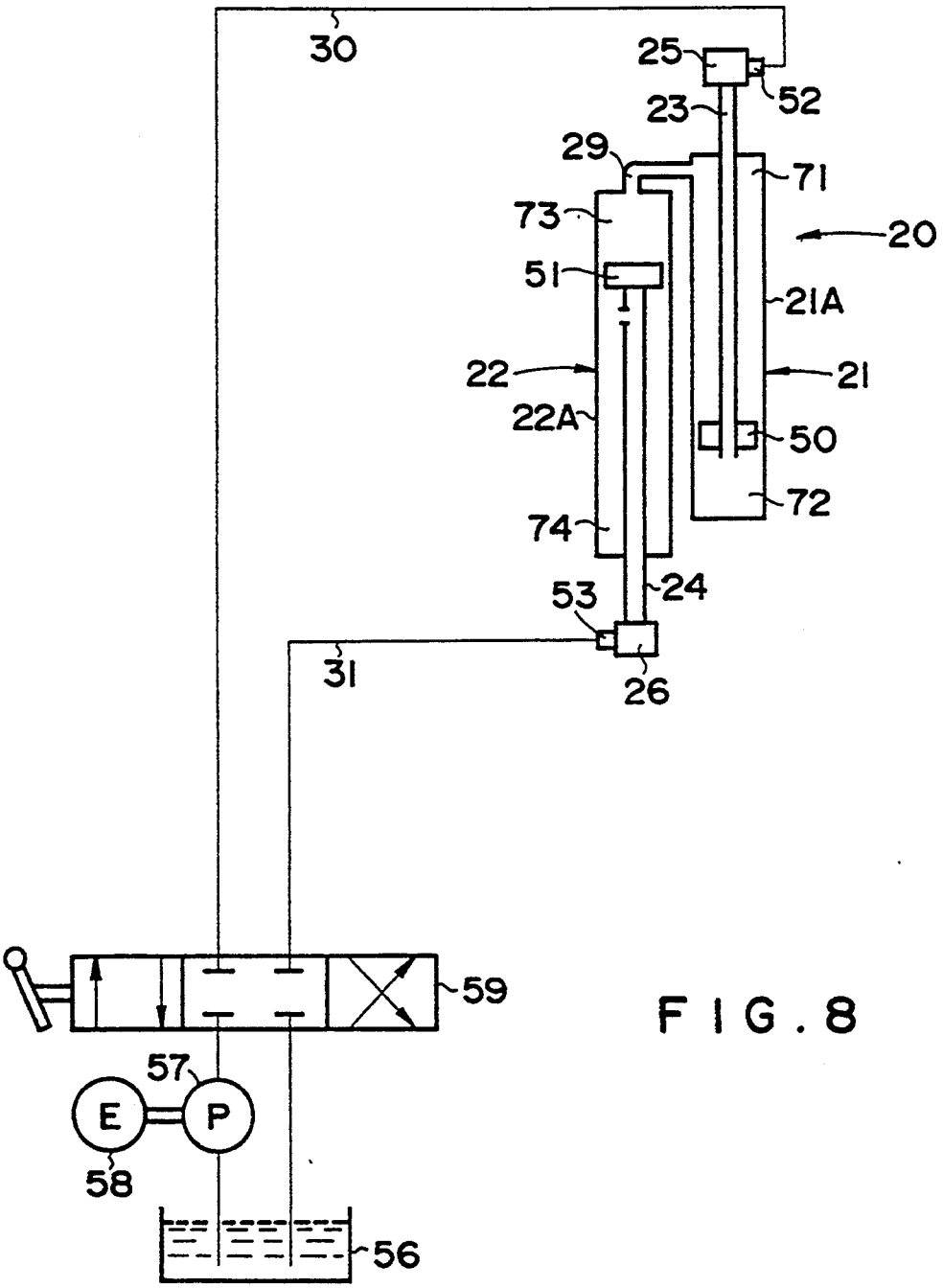
FIG. 8 is a diagrammatic view of a hydraulic system according to the present invention.

FIG. 8 shows a hydraulic circuit according to the present invention for association with the actuator device 20. In FIG. 8, a pressure oil pump 57 is driven by an engine 58 and has a suction side which communicates with an oil tank 56 for reserving oil under pressure and a discharge side which communicates with a conventional four-way directional control valve 59. The directional control valve 59 is connected to one end of the pressure application hose 30 which is connected to the port 52 of the cylinder rod 23. The directional control valve 59 is also connected to one end of the pressure application hose 31 which is connected to the port 53 of the cylinder rod 24.

The operation of the present invention will now be described.

Figure 9:
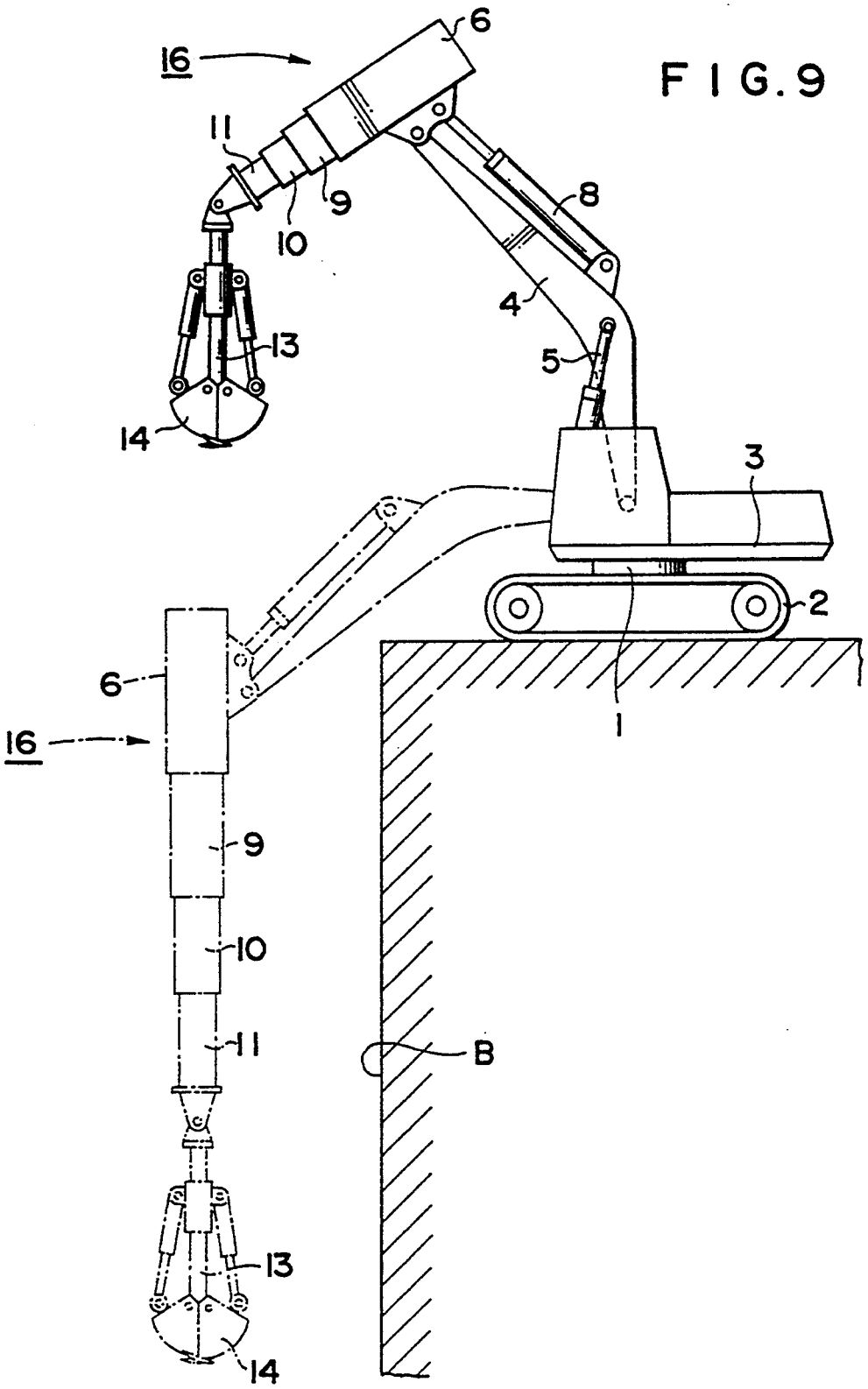
FIG. 9 is a view showing the operation of the present invention.

When the engine 58 is actuated to drive the pressure oil pump 57, the oil is sucked from the oil tank 56 by the pump 57 and is supplied to each component of the excavator, whereby each component can be operated. When the oil under pressure is appropriately supplied to the first and second hydraulic cylinders 5 and 8, the first and second hydraulic cylinders 5 and 8 are appropriately extended or contracted so that the boom 4 is vertically swingably moved and the outer arm 6 is also moved vertically. As a result, the posture of the outer arm 6 wherein it is slightly inclined as illustrated in the solid line position of FIG. 9 is changed to the one wherein it is vertically positioned relative to the bottom of the hole as illustrated in broken lines in FIG. 9.

Described hereinafter is the operation of the stretchable arm arrangement 16 for changing the state where the stretchable arm 16 is contracted as illustrated by solid lines in FIG. 9 to the state where it is extended as illustrated by broken lines in FIG. 9. That is, described hereinafter is the operation of the stretchable arm 16 from the state as illustrated in solid lines of FIGS. 1 and 9 so as to pull out the base 9, middle 10 and top 11 arms respectively from the outer arm 6 when the working unit 20 is operated.

Firstly, the directional control valve 59 is selected (rightward in FIG. 8) to the normal directional port or position so that the oil under pressure from the pressure oil pump 57 is forced to enter the port 52 by way of the pressure application hose 30. The oil under pressure which entered the port 52 passes through the interior of the cylinder rod 23 and then enters the pressure chamber 72 provided at the lower portion of the cylinder unit 21 so that the oil under pressure is expanded in the lower pressure chamber 72 to thereby push the piston 50 upward. As a result, the cylinder rod 23 is pushed upward from the hydraulic cylinder unit 21 so that the interval between the cylinder housing 21A and the rod head 25 is extended. Accordingly, the base arm 9 as connected to the cylinder housing 21A is pulled out from the outer arm 6 at the same speed as the cylinder rod 23 is extended from the hydraulic cylinder unit 21.

At the same time when the base arm 9 is pulled out from the outer arm 6, the lower roller 34 supported by the base arm 9 pushes the chain 36 downward so that the middle arm 10 connected to the chain 36 is pulled out from the base arm 9. In such a manner, when the hydraulic cylinder 21 is operated, the base arm 9 is pulled out from the outer arm 6 and at the same time the middle arm 10 is pulled out from the base arm 9.

The oil under pressure which entered the pressure chamber 72 of the cylinder unit 21 pushes the piston 50 upward in FIGS. 7 and 8 so that the oil under pressure remaining in the upper chamber 71 of the hydraulic cylinder unit 21 flows outside by way of the port 62. The oil under pressure then enters the upper pressure chamber 73 of the hydraulic cylinder unit 22 by way of the connecting hose 29 and the port 63 so as to expand in the pressure chamber 73. When the oil under pressure is expanded, the piston 51 of hydraulic cylinder unit 22 is pushed downward so that the cylinder rod 24 connected to the piston 51 is pushed downward so as to be extended outward from the cylinder unit 22, leading to an increase in the interval between the cylinder housing 22A and the rod head 26. As a result, the top arm 11 connected to the rod head 26 is pulled out from the middle arm 10 which is connected to the cylinder housing 22A.

Since the piston 51 moves downward in FIGS. 7 and 8 when the oil under pressure is expanded in the upper pressure chamber 73, the oil under pressure remaining in the lower chamber 74 of the housing 22A passes through the introduction port 54 and then enters the interior of the cylinder rod 24 and it is finally discharged from the port 53. The oil under pressure discharged from the port 53 is returned to the directional control valve 59 by way of the pressure application hose 31 and flows back to the pressure oil tank 56.

In such a manner, the hydraulic cylinder units 21 and 22 are extended at the same time so that the base arm 9 is pulled out from the outer arm 6 and the top arm 11 is pulled out from the middle arm 10 while the middle arm 10 is pulled from the base arm 9 by the chain 36, whereby the telescopically assembled arms of the stretchable arm 16 are all extended at the same time. At this time, since the middle arm 10 is pulled out from the base arm 9, the hydraulic cylinder units 21 and 22 are forced to move in opposite directions relative to each other. However, since the hydraulic cylinder units 21 and 22 are assembled by the guide rail 38 and the rollers 41 of the guide mechanism 27 so as to not transversely separate from one another, the rollers 41 move on the guide rail 38 in the longitudinal direction thereof so as to guide the cylinder housings 21A and 22A whereby both can relatively move only in the longitudinal directions thereof.

With repetition of the series operations, the hydraulic cylinder unit 21 is operated first and the hydraulic cylinder unit 22 is successively operated by the oil under pressure discharged from the pressure oil pump 57 so that both cylinder units 21 and 22 are simultaneously operated in opposite directions to thereby push the cylinder rods 23 and 24 therefrom. At the same time, since the middle arm 10 is interlocked with the base arm 9 by the chain 36, the base 9, middle 10 and top 11 arms are respectively pulled out from the outer arm 6, namely, extended in the downward longitudinal direction of the stretchable arm 16. After the stretchable arm is extended by a given length, the directional control valve 59 is returned to a middle closed position so that the extension of the stretchable arm 16 is stopped.

In such a manner, the state where the stretchable arm 16 is contracted as illustrated by solid lines in FIG. 9 is changed to the state where the stretchable arm 16 is extended as illustrated by broken lines in FIG. 9. When the bucket 14 is closably operated by the hydraulic cylinders 15 while the length of the stretchable arm 16 remains extended, the earth or sand is excavated and held by the bucket 14.

Described hereinafter is the operation when the deep excavator is in the state wherein the entire length of the stretchable arm 16 is extended to excavate and hold the earth or sand by the bucket 14, and is changed to the state wherein the stretchable arm 16 is contracted to pull the bucket 14 out of the deep hole B.

Firstly, the directional control valve 59 is switched (leftward in FIG. 8) to a reverse directional port or position so that the oil under pressure from the pressure oil pump 57 is supplied to the port 53 by way of the pressure application hose 31. The oil under pressure which enters the cylinder rod 24 from the port 53 passes through the introduction port 54 and is expanded in the lower pressure chamber 74 of the cylinder housing 22A so that the piston 51 is pushed upward in the hydraulic cylinder unit 22. Accordingly, the rod head 26 is contracted toward the housing 22A so that the top arm 11 is pulled into the middle arm 10. At the same time, since the piston 51 moves upward in the hydraulic cylinder unit 22, the oil under pressure remaining in the upper pressure chamber 73 of the cylinder housing 22A is supplied to the port 62 by way of the port 63 and the connecting hose 29 and then enters the chamber 71 of hydraulic cylinder unit 21. The oil under pressure which enters the upper pressure chamber 71 of cylinder housing 21A is expanded to thereby move the piston 50 downward so that the cylinder rod 23 is pulled into the cylinder unit 21. Accordingly, the interval between the cylinder housing 21A and the rod head 25 is contracted so that the base arm 9 is pulled into the outer arm 6. When the base arm 9 is pulled into the outer arm 6, the chain 35 is pulled upward by the upper pulley 33 so that the chain 35 pulls the middle arm 10 upward in FIG. 3 into the base arm 9. In such a manner, when the oil under pressure is supplied to the lower pressure chamber 74 of the cylinder unit 22 by way of the pressure valve 31 and the port 53, both cylinder units 21 and 22 are contracted in the length thereof whereby the base 9, middle 10 and top 11 arms are respectively pulled into the outer arm 6. As a result, the entire length of the stretchable arm 16 is contracted to thereby move the bucket 14 upward.

Since the base 9, middle 10 and top 11 arms are respectively accommodated inside the outer arm 6, the entire length of the stretchable arm 16 is contracted and returned to the state illustrated by solid lines in FIGS. 1 and 9. When the stretchable arm 16 is contracted, the bucket 14 is drawn out from the deep hole B up to the ground. Successively the first and second hydraulic cylinders 5 and 8 are actuated to incline the stretchable arm 16 and the sand and earth excavated by the bucket 14 can be discharged to the load-carrying platform of a truck, etc.

With repetition of such series of operation, it is possible to excavate the sand and earth to thereby form a hole having a deep depth relative to the diameter thereof. When excavating the earth or sand to form the deep hole B, the directional control valve is switched to the normal position while the bucket 14 keeps in contact with the bottom surface of the deep hole B, and the bucket 14 is pushed downward to the bottom surface of the deep hole B so that the amount of earth or sand to be excavated by the bucket 14 can be increased.

With an arrangement according to the present invention, it is possible to excavate earth or sand to form a deep hole by a stretchable arm comprising four arms in which the bucket is suspended by the top arm. Since the four arms of the stretchable arm can be extended and contracted at the same time by the working unit comprising a pair of hydraulic cylinder units, the extending and contracting speeds can be increased to thereby enhance the working efficiency. Although the three arms of my prior stretchable arm can be extended and contracted at the same time, the four arms of the present stretchable arm can be extended and contracted at the same time so that it can form a deeper hole.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A deep excavator comprising:

a chassis, a turntable disposed on the chassis, a boom which is pivotally supported on the turntable and is vertically swingable, a stretchable arm arrangement which is stretchable in the longitudinal direction thereof and comprises four telescopically assembled outer, base, middle and top arms, a working unit accommodated in said stretchable arm arrangement for extending and contracting said arm arrangement, and a bucket which is attached to the top arm for excavating and holding earth or sand, wherein:

said working unit comprises first and second hydraulic cylinder units which are arranged in parallel with each other with respective first and second elongate cylinder rods thereof disposed to operate in opposite directions, wherein said first hydraulic cylinder unit includes a housing coupled to the base while the cylinder rod thereof is coupled to the outer arm, wherein said second hydraulic cylinder unit includes a housing coupled to the middle arm while the cylinder rod thereof is coupled to the top arm, and a synchronous means disposed between the base and middle arms for pulling out the middle arm from the base arm at the same time as the base arm is pulled out from the outer arm.

2. A deep excavator according to claim 1, wherein said synchronous means comprises a pair of long flexible elements each having one end connected to a tip end of the outer arm and the other end connected to a rear end of the middle arm, and wherein said flexible elements are entrained around inner and outer peripheries of said base arm.

3. A deep excavator according to claim 1, wherein a pressure chamber of said first hydraulic cylinder unit communicates directly with a pressure chamber of said second hydraulic cylinder unit.

4. A deep excavator according to claim 3, wherein a guide mechanism cooperates between the housings of said first and second hydraulic cylinder units to permit relative movement therebetween only in the longitudinal direction thereof.

5. A deep excavator according to claim 1, wherein the first cylinder rod is hollow and communicates adjacent one end thereof with a pressure chamber of said first hydraulic cylinder and adjacent the other end thereof with a pressure supply source, and wherein the second cylinder rod is hollow and communicates adjacent one end thereof with a pressure chamber of said second hydraulic cylinder and adjacent the other end thereof with the pressure supply source.

6. A deep excavator according to claim 5, wherein a guide mechanism cooperates between the housings of said first and second hydraulic cylinder units to permit relative movement therebetween only in the longitudinal direction thereof.

7. A deep excavator according to claim 1, wherein a first pressure chamber of said first hydraulic cylinder unit communicates directly with a first pressure chamber of said second hydraulic cylinder unit, wherein the first cylinder rod is hollow and communicates adjacent one end thereof with a second pressure chamber of said first hydraulic cylinder unit and adjacent the other end thereof with a pressure supply source, and wherein the second cylinder rod is hollow and communicates adjacent one end thereof with a second pressure chamber of said second hydraulic cylinder unit and adjacent the other end thereof with the pressure supply source.

8. A deep excavator according to claim 1, wherein a guide mechanism cooperates between the housings of said first and second hydraulic cylinder units to permit relative movement therebetween only in the longitudinal direction thereof.

9. A deep excavator according to claim 8, wherein said guide mechanism comprises a guide rail fixed to the housing of one hydraulic cylinder unit and rollers which are supported by the housing of the other hydraulic cylinder unit and roll on said guide rail.

* * * * *

UNITED STATES PATENT AND TRADEMARK OFFICE

CERTIFICATE OF CORRECTION

PATENT NO. : 5 377 432

DATED : January 3, 1995

INVENTOR(S) : Mitsuhiro KISHI

It is certified that error appears in the above-indentified patent and that said Letters Patent is hereby corrected as shown below:

Column 10, line 18; after "base" insert ---arm---.

Signed and Sealed this

Twenty-fifth Day of April, 1995

*Attest:*

Bruce Lehman

BRUCE LEHMAN

*Attesting Officer*

*Commissioner of Patents and Trademarks*